US005887647A

United States Patent [19]

Melville et al.

[11] Patent Number: 5,887,647

[45] Date of Patent: Mar. 30, 1999

[54] DECREASING CONTAMINATION OF MOLTEN METAL PRIOR TO SOLIDIFICATION CASTING

[75] Inventors: Scott D. Melville, Toronto, Ohio; Richard E. Hauldren, Weirton, W. Va.

[73] Assignee: Weirton Steel Corporation, Weirton, W. Va.

[21] Appl. No.: 639,524

[22] Filed: May 1, 1996

[51] Int. Cl.[6] ..... B22D 11/07; B22D 11/10

[52] U.S. Cl. ..... 164/472; 164/473; 164/475; 164/488; 222/603

[58] Field of Search ..... 164/266, 417, 164/475, 133, 134, 488, 439, 437, 472, 473; 222/603, 590, 595

[56] References Cited

U.S. PATENT DOCUMENTS

| | | | |
|---|---|---|---|
| 3,469,740 | 9/1969 | Crowe | 222/595 |
| 5,232,046 | 8/1993 | Gallucci et al. | 164/488 |

FOREIGN PATENT DOCUMENTS

| | | | |
|---|---|---|---|
| 61-283445 | 12/1986 | Japan | 164/437 |
| 2-41744 | 2/1990 | Japan | 164/437 |

*Primary Examiner*—Patrick Ryan
*Assistant Examiner*—I.-H Lin
*Attorney, Agent, or Firm*—Shanley and Baker

[57] ABSTRACT

The invention provides continuously-cast product free of ambient atmosphere contaminants and free of nonmetal solid entrapment. Methods and apparatus are provided for flow of molten metal from ladle to tundish to mold machine, free of contact with ambient atmosphere; and, tundish slag cover is removed, by discharge of a nonreactive gas to provide a selected limited surface area of tundish metal, which is free of slag cover, for insertion of a ladle shroud to deliver molten metal, free of entrapment of nonmetal slag cover, for continuous casting. Transitional casts, before clean metal is obtainable with each new ladle of molten metal, are eliminated; and the duration of uninterrupted continuous casting of clean metal is extended.

10 Claims, 7 Drawing Sheets

DECREASING CONTAMINATION OF MOLTEN METAL PRIOR TO SOLIDIFICATION CASTING

This invention is concerned with maintaining characteristics of molten metal, as produced, during handling for continuously casting into solid form suitable for processing into commercial product.

Chemically-active commonly-used metals as prepared to desired compositions and levels of purity in a molten state are especially susceptible to contamination prior to solidification. For example, low-carbon steel can be contaminated by gaseous elements of the ambient atmosphere; and, also, by entrapment of nonmetal solids while being transferred toward solidification casting.

SUMMARY OF THE INVENTION

Primary objectives of this invention are (a) to avoid ambient atmosphere and nonmetal entrapment contamination of molten metal, (b) to deliver continuously-cast solidified metal of a composition as refined and processed in the molten state, and (c) to provide for significantly-increasing uninterrupted contamination-free continuous casting of molten metal.

The above and other advantages and contributions of the invention are described in more detail in relation to the accompanying drawings.

DETAILED DESCRIPTION OF THE INVENTION

Metal refining and other treatment(s) of molten metal are carried out to produce a desired composition, and level of purity, prior to casting into desired shapes (slabs, bar stock, etc.). Operations at elevated temperatures and in large tonnage quantities are taken into consideration in the present invention, along with providing teachings to avoid contamination of the molten metal throughout the transition from desired molten metal to continuously-cast solidifying metal.

Methods and means are provided to eliminate contamination of molten metal by contact with ambient atmosphere and, also, to eliminate entrapment of nonmetal solids so as to produce continuously-cast metal substantially free of contaminants.

A low-carbon steel embodiment is utilized for purposes of describing methods and apparatus which avoid such gaseous and solid types of contamination so as to produce continuously-cast clean steel. Also, methods and means are disclosed for significantly increasing the duration of uninterrupted continuous casting of clean steel.

Coaction of apparatus and processing steps are required in order to avoid contamination during uninterrupted continuous casting of sequential molten metal heats, as taught herein. The specific embodiment described enables flow of molten metal by gravity, which is preferable with large tonnage operations; and, at each molten metal transfer stage, flow control procedures and means are provided to avoid contamination.

Figure 1:
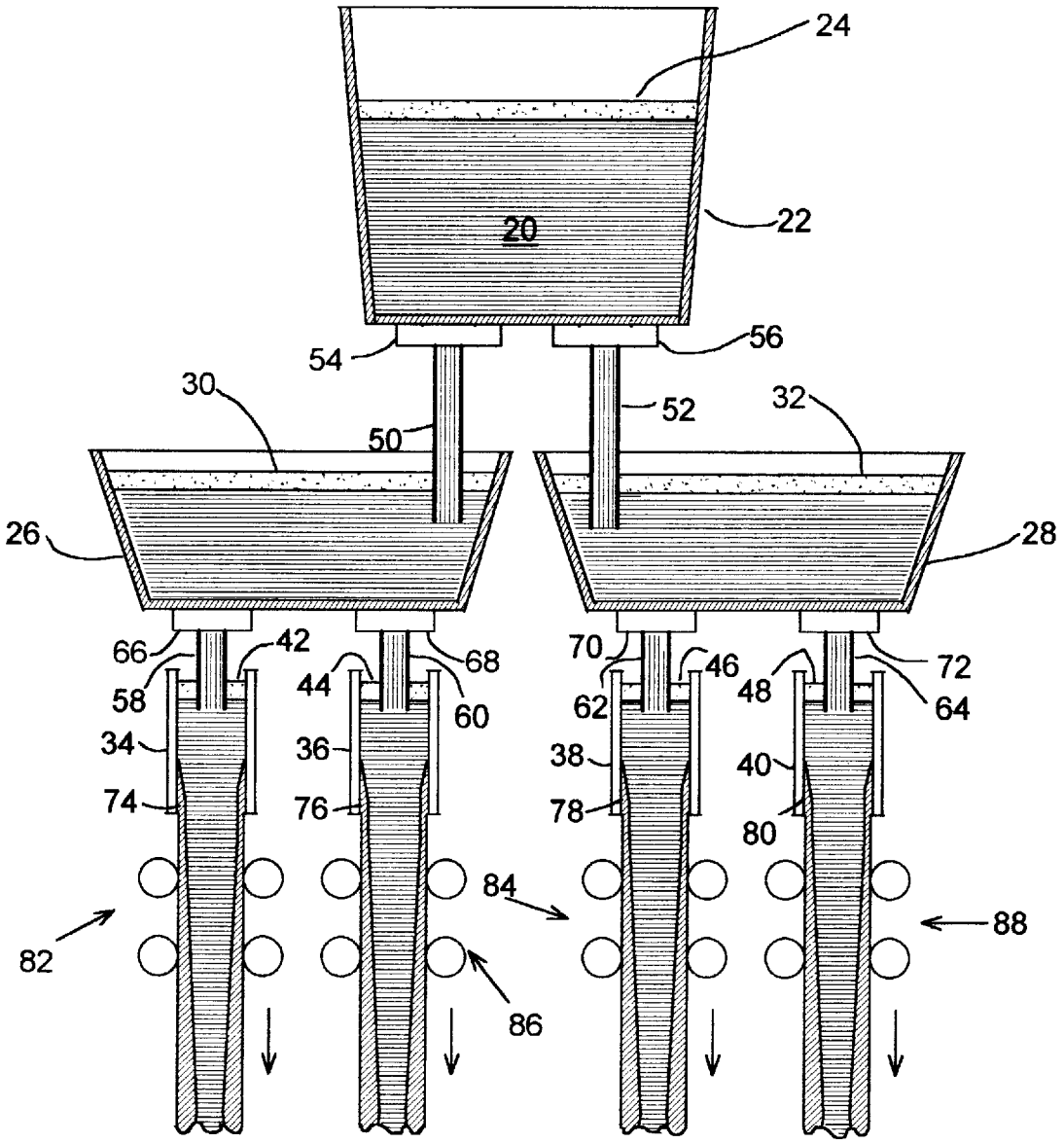
FIG. 1 is a schematic general arrangement of molten metal handling means for describing a combination of steps and apparatus for continuous casting of the invention.

In FIG. 1, the surface of molten metal 20, in ladle 22, is protected by slag cover 24. At a holding and transfer station (referred to as a tundish), flow control of molten metal en route toward continuous casting is exercised. At the holding station of FIG. 1, molten metal from ladle 22 is discharged into a pair of tundishes 26 and 28. Slag cover 30, 32 respectively, is established at the upper surface of the molten metal in each such tundish. Slag cover, as provided by the invention, has semi-liquid, high viscosity characteristics for preventing contamination by ambient atmosphere and inhibiting loss of heat from tundish molten metal.

However, tundish slag cover has been an unintended source of solid nonmetal contamination during past molten metal transfer processing for continuous casting. Continuous casting has been more prevalent with low-carbon steel than other metals. Such contamination problems were either not properly recognized or not analyzed, and solutions were not provided in the steel industry prior to present teachings.

In the embodiment of FIG. 1, protection from ambient atmosphere, at an upper open-access portion of a tundish, is provided for molten metal during discharge from ladle 22 into each of such pair of tundishes. Slag-forming additions are made, and slag cover 30, 32 is controlled for each respective tundish 26, 28. A suitable nonmetal slag cover for low-carbon steel is provided by the addition of rice hulls to such open-access upper surface.

In the combination of the invention, protection of the molten metal from ambient atmosphere is also provided during flow control from each tundish to each of its respective continuous casting molds as indicated in FIG. 1. Tundish 26 supplies molten metal to casting molds 34, 36 for continuous casting, and tundish 28 supplies molten metal to casting molds 38, 40 for continuous casting.

Contamination protection is provided en route to and at the surface of the casting molds. A mold lubricant provides upper surface cover, as indicated at 42, 44, 46, 48, in each respective casting mold. In addition, such surface cover provides mold lubrication for the continuous movement of each mold casting, which initially solidifies by cooling the inner periphery surface of each casting mold; peripherally solidified casting is withdrawn from each mold continuously after such initiation of the solidification.

In addition to upper surface protection of molten metal at each of the above-described locations, molten metal flow streams, which could otherwise expose a significant surface portion of the molten metal to contamination by ambient atmosphere, are protected. Molten low-carbon steel, for example, can be contaminated by contact with ambient atmosphere. Flow control means, and flow streams between ladle and tundish, and between tundish and casting molds, are purged of ambient atmosphere by nonreactive gas under pressure. Such flow streams are shielded within shrouds, as shown in FIG. 1, in the combination taught. Such shrouds are formed from ceramic materials.

In FIG. 1, an elongated ladle shroud 50, 52 extends from each ladle discharge control means 54, 56, respectively, toward each tundish 26, 28. To ensure that no detrimental ambient elements are aspirated into control means for molten metal delivery or protective shrouds, a positive pressure nonreactive gas atmosphere, such as argon fed from a pressurized line (not shown) maintains a nonreactive gas pressure in each molten metal delivery control means and shroud so as to prevent ambient atmosphere contamination to the maximum practical extent.

Each elongated tundish shroud 58, 60, 62 and 64 extends, from its respective tundish flow control means 66, 68, 70 and 72, toward its respective casting mold 34, 36, 38 and 40, and is protected against ambient atmospheric contaminant aspiration by positive pressure of a nonreactive gas, such as argon fed by a pressurized line to each (not shown).

The teachings of the present invention enable the duration of uninterrupted continuous-casting production of clean metal to be significantly increased by eliminating contamination which was found to be previously associated with interruptions due to replacement of ladles of molten metal from sequential metal refining heats.

It was found that tundish metal slag cover was being entrapped, during ladle changeover, at the discharge end of each new ladle shroud, during entry of each such shroud through the slag cover into the tundish molten metal. Also, and equally as significant, it was found that such entrapped slag was dispersed as relatively small particles by opening of the ladle flow control means and delivery of ladle molten metal into each tundish. Such small nonmetal particles were scattered throughout tundish molten metal.

And, of further significance, such slag particles would remain dispersed in tundish molten metal over a relatively long period of time. That is, residence time of molten metal in each tundish is not sufficient to allow such small nonmetal solid particles to move upwardly and return to the tundish slag cover. Also, delay of casting to increase such time is not a practical alternative; and, is not likely to be successful within reasonable times because of the particulate size.

Therefore, such small particle nonmetal solid contaminants were being cast as part of the solidified shape for a relatively extended period after initiation of delivery from each ladle. Stated otherwise, such solid contamination of the cast shape(s) was taking place throughout a transition phase during which contaminated tundish metal was gradually diluted, after the initial metal delivery from a replaced ladle source of molten metal. That is, as ladle metal was being added, nonmetal solid-particle contaminated metal was gradually decreased during a transition period. That transition phase, and resulting transition casts (slabs, bars, etc.), could extend over about thirty to about fifty percent of the continuously-cast shape(s). And, in the steel industry for example, those transition casts could not be used for fabrication of many of the one-piece can bodies, having thinner side walls, which depend on clean flat-rolled steel.

Figure 2:
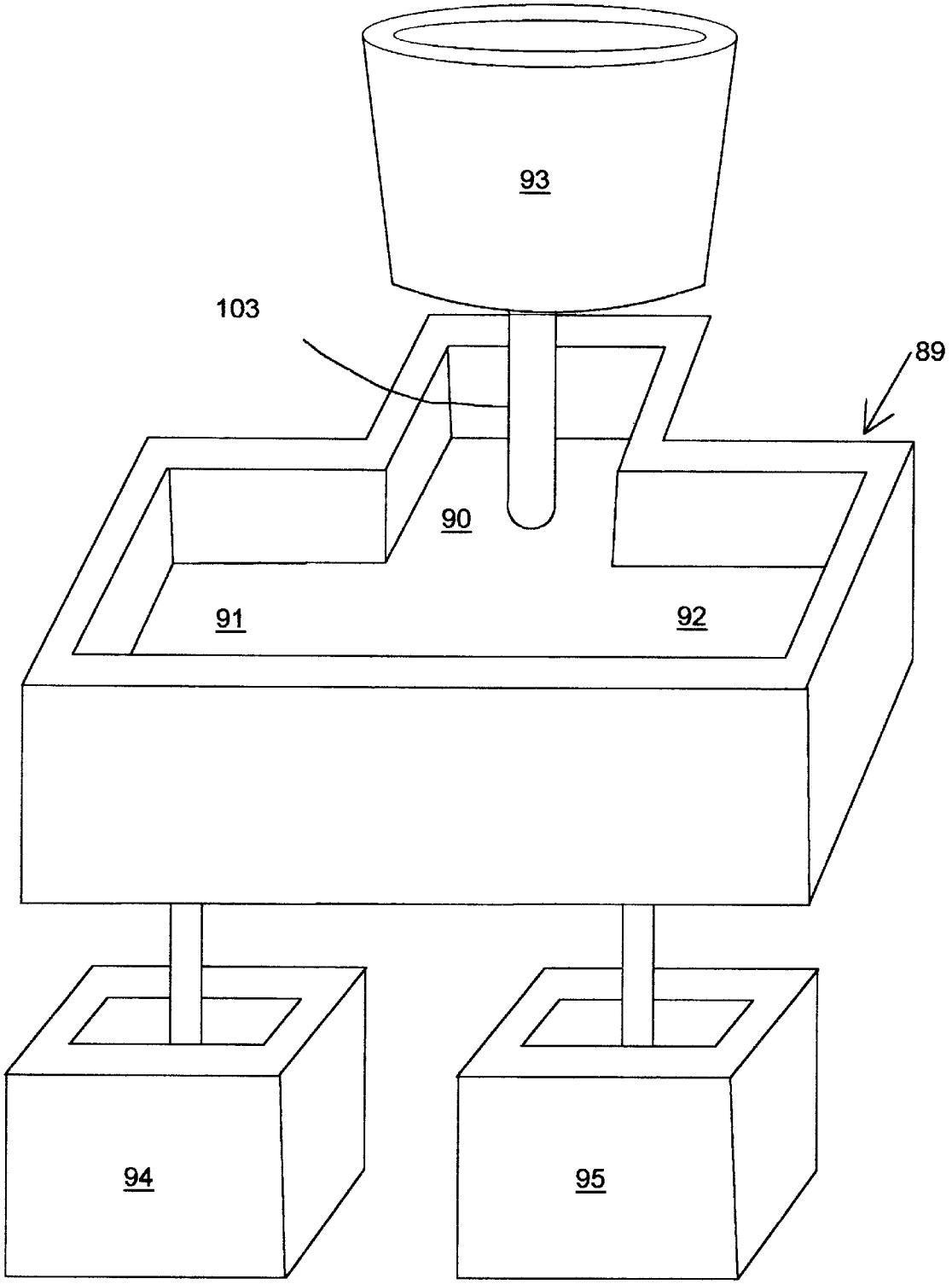
FIG. 2 is a schematic perspective view of a specific embodiment of molten metal handling and continuous casting apparatus of the invention.

FIG. 2 shows a differing view, than shown in FIG. 1 of single tundish portion for purposes of describing a preferred tundish configuration. Such a tundish is referred to and shown in more detail in FIGS. 3 through 5.

In FIG. 2, tundish 89 presents a "pouring box" section 90 and casting metal delivery areas 91, 92 which are spaced from the pouring box. Such pouring box section provides an area for delivery of molten metal from ladle 93; such area is located to help decrease disturbances of the molten metal in each delivery area (91, 92) of the tundish from which molten metal is delivered to mold means (94, 95 respectively) for continuous casting.

A slag layer is provided on the open-access upper surface of molten metal, throughout the tundish, covering each delivery area and the pouring area. As mentioned, such slag layer is selected to provide a viscose, semi-liquid cover in order to inhibit heat loss and ambient air contamination. But, such slag cover has been a source of detrimental small particle nonmetal inclusions, which are dispersed, as mentioned above. The present combination of steps and apparatus is primarily concerned with limited slag-cover movement, in a selected surface area, in order to eliminate nonmetal solid contaminants to the extent effectively and efficiently practical.

The invention teaches method and means for a timely, but short-time interval, establishing a selected surface area of tundish molten metal which is free of slag cover. In the specific embodiment for description of the invention, that area is preferably located in the pouring box section 90 (FIGS. 2, 3) of a tundish. Such slag-free area is formed by discharging nonreactive gas, e.g., argon and/or nitrogen, to displace slag cover. In a specific embodiment, upward flow of such a gas from a submersed nozzle 96 (FIGS. 3, 4), preferably located within tundish pour box section 90, causes such displacement of slag cover.

In the preferred embodiment, submerged nozzle 96 is supplied with argon gas by conduit 97. Argon, as dispensed by submerged nozzle 96, rises upwardly (as indicated at 99, FIG. 4) to surface 100 of the molten metal. Such rising argon, and its discharge through the molten metal surface at 100, moves slag cover 101 from such selected surface area of FIG. 4. Such gas displaces slag cover to provide a slag-free area 102 at such accessible molten metal surface. Such slag-free area 102 is indicated in plan view in FIG. 5; and, can be referred to as an "eye" or a "window" opening in the slag cover. That window is purposely opened only temporarily, as described later.

In the embodiment shown, and as preferred in handling large tonnages, such slag-free designated area, 102, is located, substantially centrally of pouring box 90, at an appropriate area for descending movement of ladle 93, and attached ladle shroud 103, for insertion of the latter through such "eye" 102.

In practice of the invention, timing for forming, and duration of such a slag-free area (102) are achieved in synchronism with lowering of the source of metal, such as ladle 93. The discharge distal end of a shroud (103) is inserted through the "eye" 102 (FIGS. 4, 5), and through exposed metal surface 100 so as to be submersed in the tundish molten metal. At which time, that is when the discharge distal end of each shroud is submersed in tundish molten metal, flow of slag-displacement gas (pressurized argon) from nozzle 96 is terminated (as described in more detail later in relation to FIG. 6).

Referring to FIG. 1, molten metal is delivered, free of exposure to ambient atmosphere, to the casting molds 34, 36, 38, 40 at a rate determined by flow control means 66, 68, 70, 72, respectively. The casting molds are cooled to remove heat so as to solidify at least a peripheral shell of cast metal within each mold. The cast moves vertically downwardly as a solidified peripheral shell 74, 76, 78, 80 is formed in each respective mold.

Such solidified peripheral shell must be of sufficient thickness to contain, along with peripherally-located roll supports 82, 84, 86, 88, a molten metal core as the solidified-shell exits from the bottom of each mold. Casting rate is selected to achieve desired shell solidification. After exit from each such casting mold, such peripheral rolls support the cast metal as it is sprayed with cooling fluid to further remove heat from the metal and complete solidification.

Molten metal level in such casting molds is maintained within a substantially consistent range. Such level is maintained by tundish flow control means 66, 68, 70, 72, as well as by the casting rate. Molten metal level in the tundish is also maintained within a substantially consistent range by the ladle delivery control means 54, 56; and, the casting rate selected for a particular stage.

During operations, molten metal in the ladle is supplied to the tundish until ladle slag is first detected, by a slag-detecting means (not shown), approaching the delivery control means of the ladle. At such time, discharge from that ladle is terminated. And, the casting rate, at each mold, is decreased to a ladle-changeover casting rate.

A decreased flow of molten metal from the tundish, in conjunction with the decreased casting rate, provides time for ladle changeover. That is, time for a replacement ladle, filled with molten metal, to be moved into position, slag cover to be moved from an "eye" (102), lowering of the ladle shroud into place, and delivery of molten metal started from the replacement ladle into the tundish(es). Such ladle delivery is free of nonmetal solids from slag cover(s), due to procedures for forming an "eye" 102, exposing slag-free surface 100, as described above.

That is, upon verification of a slag-free area of exposed molten metal of sufficient cross-section (FIG. 5) to accommodate the ladle shroud, a replacement ladle and shroud can both be lowered, in vertically aligned embodiments, so as to submerge the shroud discharge distal end beneath the selected slag-free molten metal surface area. And, with verification of such submersion, the argon (or other nonreactive gas) discharge from submersed argon nozzle 96 is terminated, as delivery of molten metal from the replacement ladle is started. Such molten metal delivery, subsurface of tundish molten metal, is free of particles of slag cover. With submersion of the shroud, and discontinuing of nonreactive gas discharge from nozzle 96, the tundish slag cover moves to surround the shroud and terminate any exposure of tundish molten metal at its upper surface. The amount of surface exposure of molten metal is minimal during the changeover, and, of short time duration.

From the outset of such changeover, the casting rate is decreased to the "ladle-changeover" rate. Such decreased casting rate provides for a continuing supply of molten metal from the tundish to sustain such continuous casting process, at a decreased rate, during the ladle-changeover period.

Figure 6:
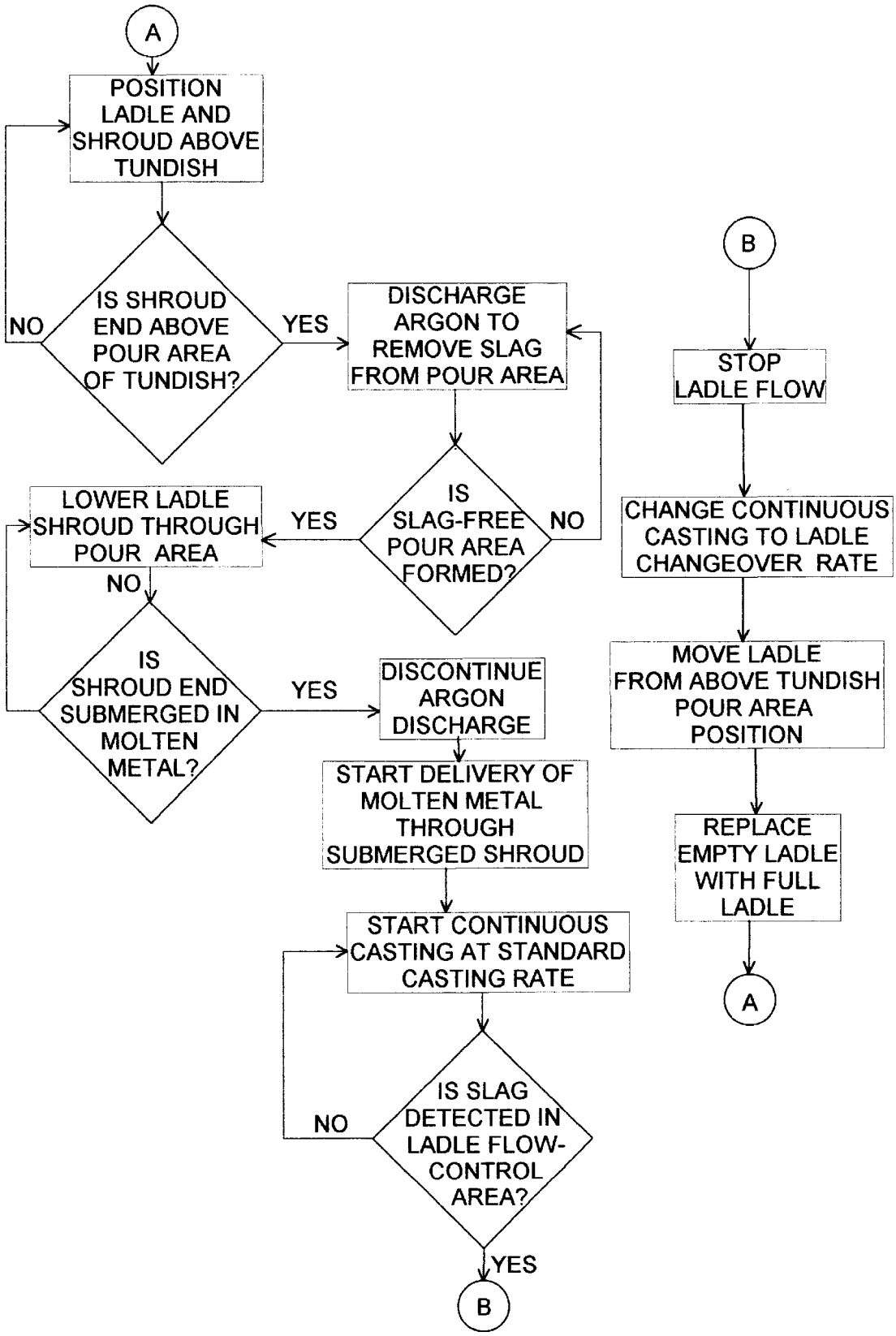
FIG. 6 is a flow chart for describing operations of the invention with a specific embodiment as shown in FIGS. 1 through 5.

A ladle-changeover procedure of the invention is depicted by the flow chart of FIG. 6. As ladle discharge establishes the desired level for the tundish molten metal reservoir, the rate of casting is gradually increased from the ladle-changeover rate to a selected "standard" casting rate. At such a selected standard casting rate and steady-state condition, a desired molten metal level in the molds, and the established molten metal reservoir level in each tundish are maintained until the molten metal in the ladle again reaches a level at which ladle surface slag can be detected near the ladle flow control means. At such time, flow from the ladle is stopped to assure that ladle slag is not delivered to the tundish, and the casting rate is decreased to the ladle-changeover rate.

The substantially empty ladle is raised, moved from its position above the tundish pour area, and a filled alternate ladle source of molten metal is moved into position to repeat the described steps.

Such procedure, carried out on sequential metal refining heats (for example, electric furnace or Basic Oxygen Process (BOP) heats of low-carbon steel), provides for uninterrupted production of "continuous-cast" slabs, bars, etc. free of inclusions due to entrapment of slag cover and eliminates "transition" phase casts throughout an extended continuous-casting period.

Such casting, free of slag-cover entrapment, is continuous from the initial heat and throughout each subsequent ladle changeover heat. Such desired continuing sequential-heat continuous casting utilizes and coordinates supporting processes; for example, metal refining capacity and desired cutting rate of the solidified continuous casting are maintained.

Longer range factors which can interrupt continued sequential heat continuous casting include such physical equipment characteristics as:

(1) tundish refractory life;

(2) nozzle life for molten metal delivery control, at ladle and/or tundish, and (3) requirements for a mold size change.

Figure 7:
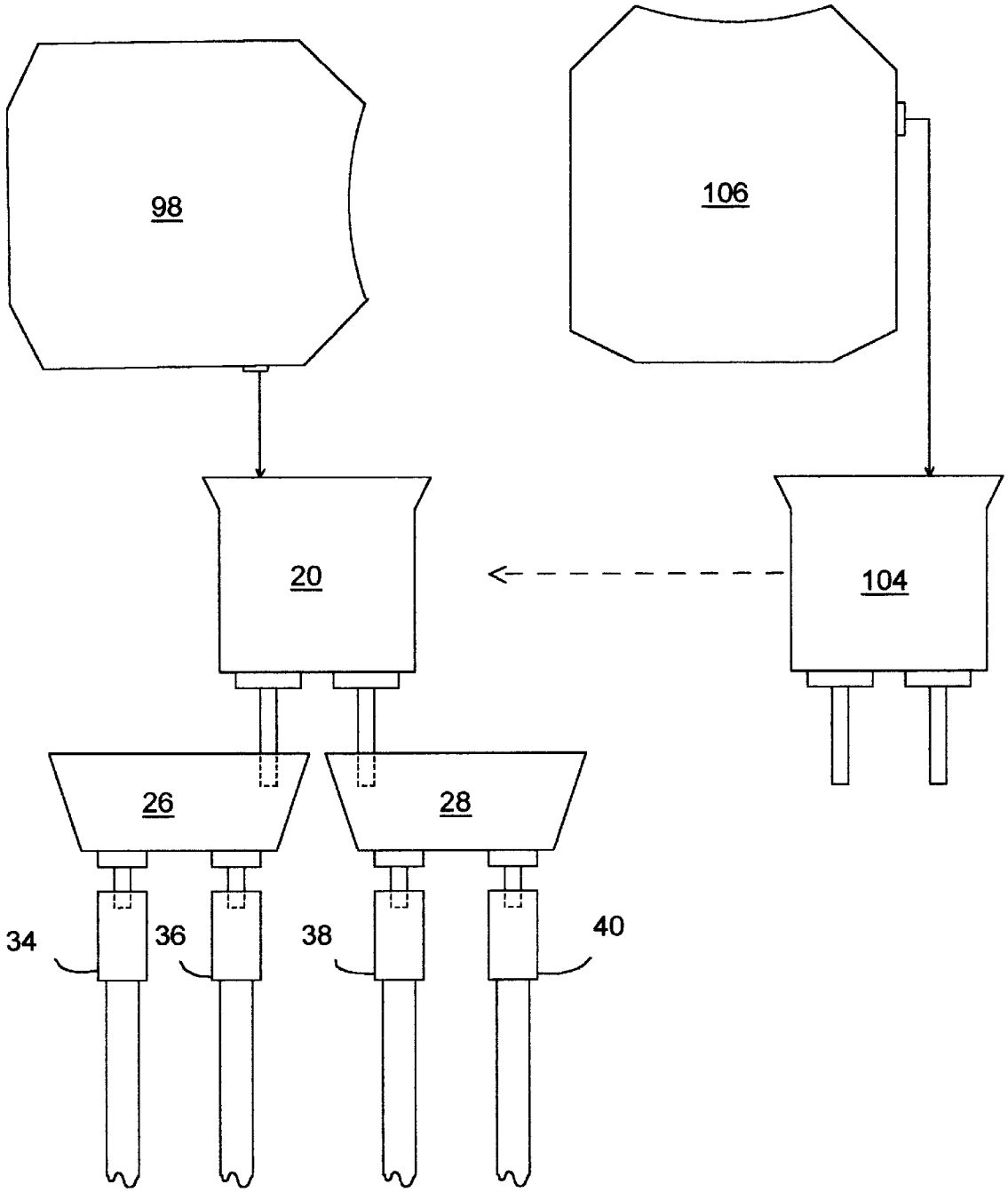
FIG. 7 is a schematic general arrangement of combined molten metal producing and continuous casting apparatus of the invention.

FIG. 7 schematically depicts metal heat preparation (such as a basic oxygen steelmaking heat, or other type of heat) and use of an alternate ladle 104. The latter enables expeditious ladle changeover for non-interrupted continuous casting of sequential heats.

An alternate metal refining vessel 106 is also shown. Need for such an alternate vessel is dependent upon heat time; that is, metal refining time. If such heat time is less than the time selected for continuously casting of a previous heat, an alternate metal refining vessel (such as 106) may not be required.

Figure 8:
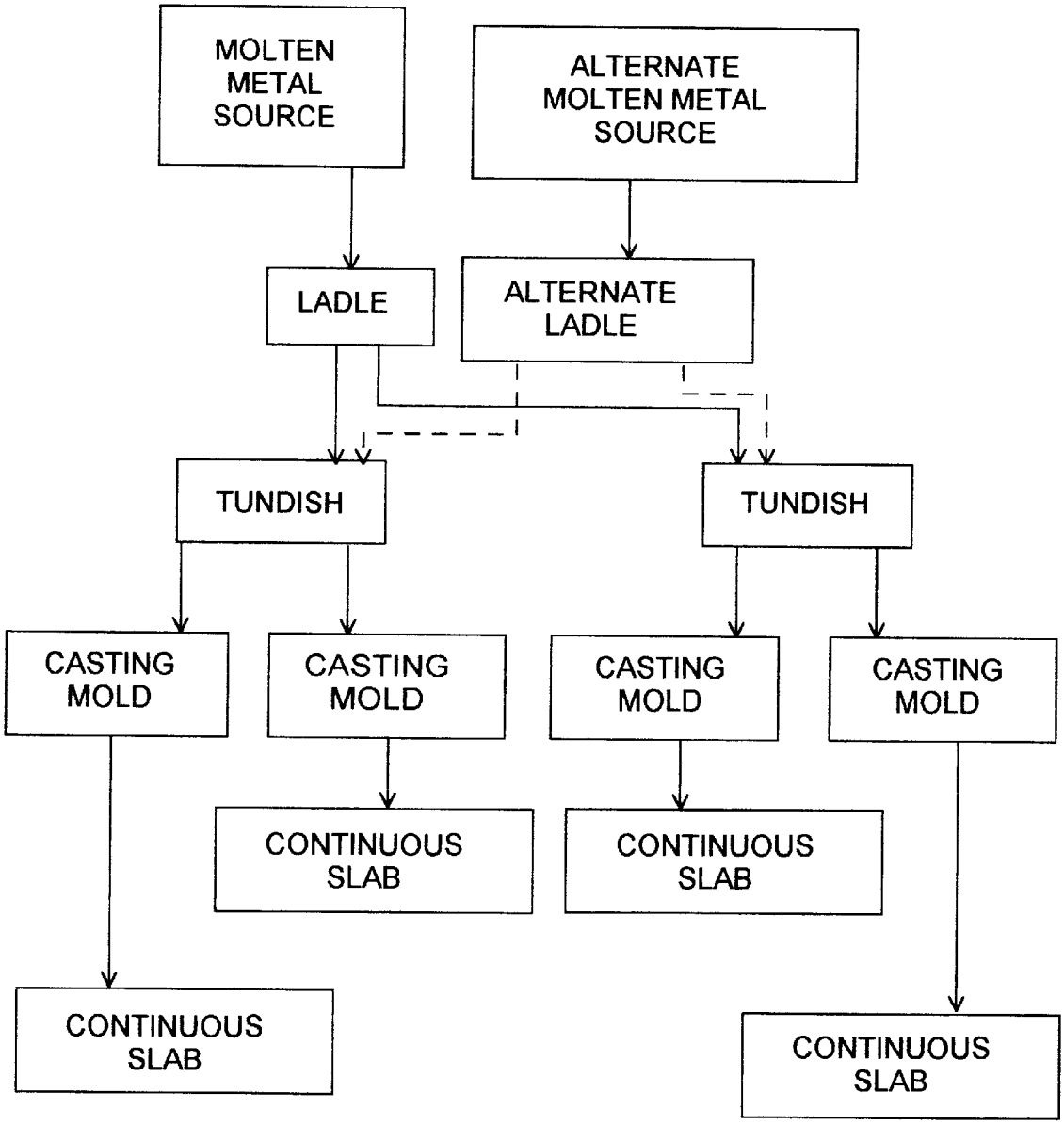
FIG. 8 is a box diagram for describing operation of the apparatus of FIG. 7.

FIG. 8 is a self-explanatory box diagram showing the use of such alternate molten metal source and ladle as they are used within a continuous casting operation of the invention.

Demands for cleaner metal are increasing with changes in metal fabricating technologies of certain metals. The described processing enables continuous casting of clean stainless steel, aluminum, copper, magnesium and alloys of such metals, as well as many ferrous metal alloys, in particular low-carbon steel having a carbon content of less than 0.30% C by weight. Testing for "clean" metal is largely determined by requirement of the consumer product to be fabricated from a particular metal.

In a preferred embodiment of the invention, lowcarbon or mild steel (can extend from about 0.05% C to 0.25% C by weight) is predominantly produced by the Basic Oxygen Process (BOP) which provides a continuing sequential-heat source of molten steel for uninterrupted continuous casting. A consumer test product for clean steel comprises drawn, or drawn and ironed, one-piece can bodies in which side walls are thinned to about 0.0035 inch thickness; also, open end chime-seam metal must be capable of being double-seamed with the chime-seam metal of an end closure for such open end.

Figure 3:
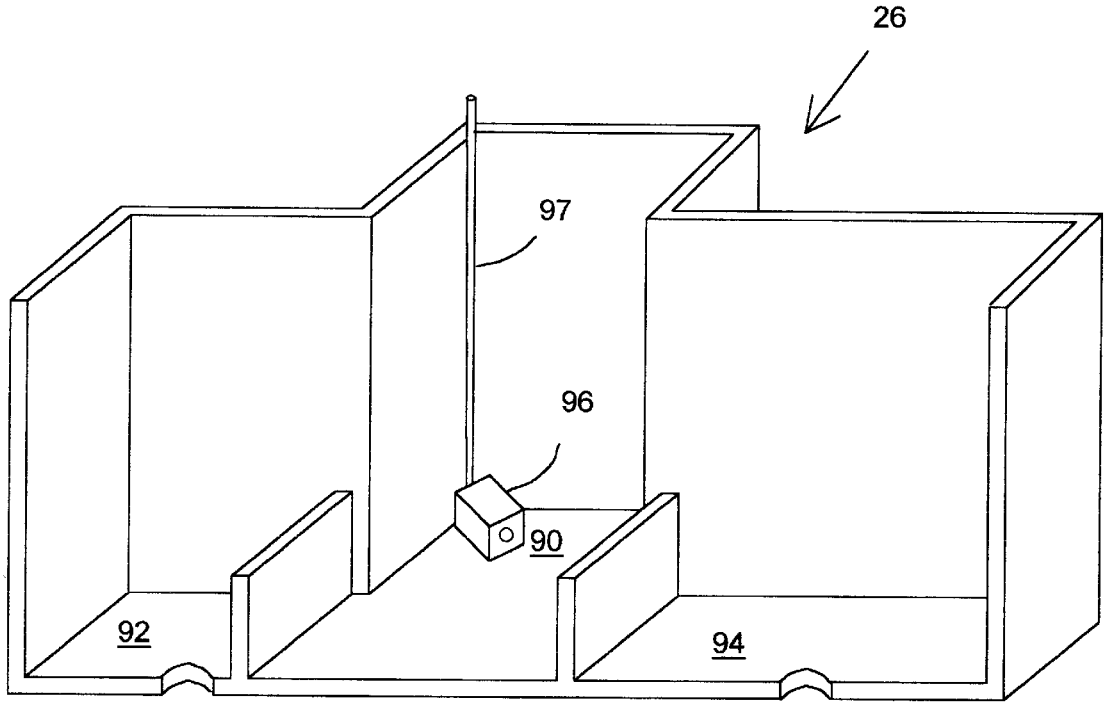
FIG. 3 is a schematic perspective view, with portions cut away, of a specific embodiment of molten metal receptacle and transfer apparatus of the invention.
Figure 4:
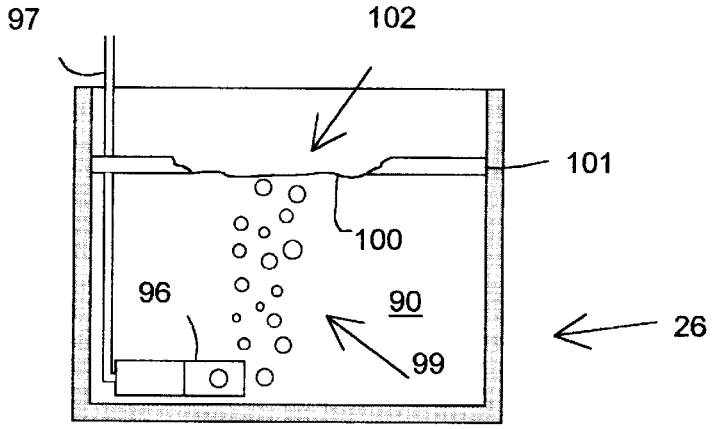
FIG. 4 is a schematic cross-sectional view in elevation of a portion of FIG. 3, with molten metal in place, for describing a specific embodiment of the invention.
Figure 5:
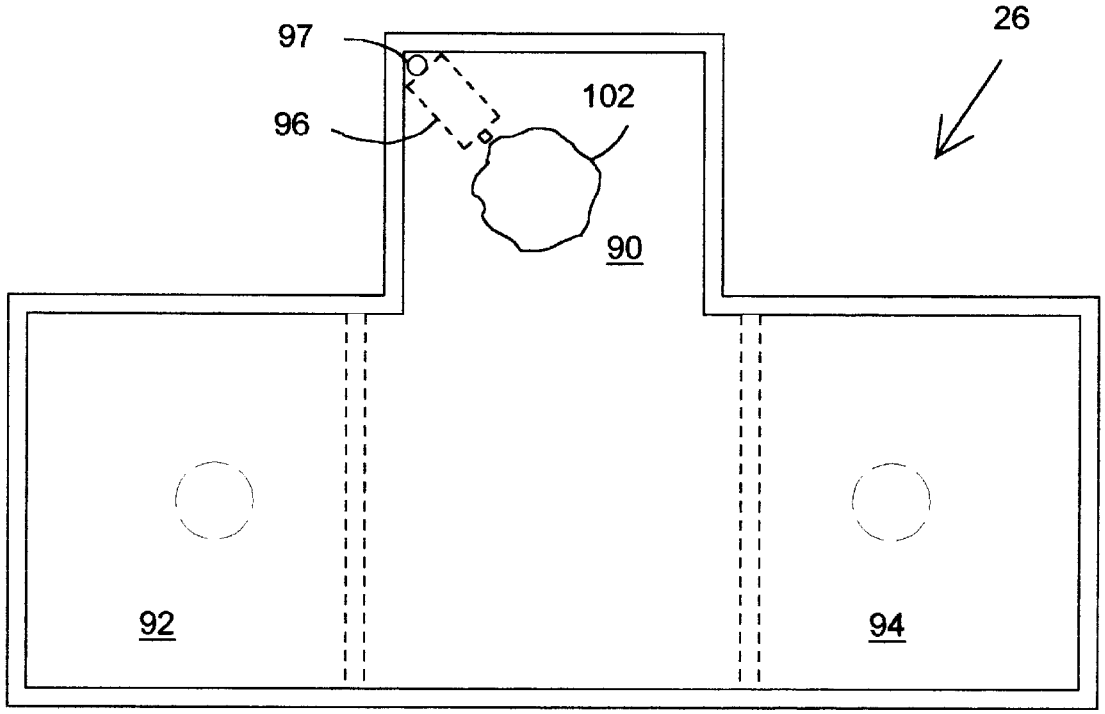
FIG. 5 is a schematic plan view of the apparatus of FIG. 3, with molten metal in place, for describing functions depicted by FIG. 4.

As shown in FIGS. 3, 4, argon is discharged through a porous ceramic nozzle (96) embedded in the refractory lining of a holding vessel, such as a tundish, to establish a selected surface area which is free of slag cover, located in the pour box section (90) of the tundish. The molten steel is delivered from the tundish to water-cooled molds and cast into slabs of selected cross-sectional dimensions, for subsequent hot rolling and cold rolling to produce a flat-rolled clean steel as required for fabricating such can bodies and end closures for completing closure of a can.

TABULATED DATA
(Approximate Values)

| | |
|---|---|
| BOP HEAT | |
| Capacity | 350 tons |
| Cycle Time (including furnace charging and teeming of ladle) | 45 min. |
| TEEMED LADLE | |
| Capacity | 350 tons |
| Discharge Nozzles | 2 |
| LADLE CHANGEOVER AT TUNDISH (ES) | 3 to 5 min. |
| TUNDISH | |
| Capacity | 2 @ 50 tons |
| Refractory Life (currently) | about 16 hrs. |
| Casting Time Available During Ladle Changeover | 8 to 10 min. (depending on casting rate) |
| CONTINUOUS CASTER | |
| Caster Strands | 4 |
| Casting Time for a Heat at Selected Standard Casting Rate | about 40 to 45 min. |
| Time at Selected Changeover Casting Rate | 3 to 5 min. |

In relation to the above-tabulated data:

two tundishes each supply two continuous casting molds for casting a total of four continuous strands at a time;

mold size changes, dependent upon market orders, can interrupt casting for approximately ninety minutes;

tundish replacement to provide for refurbishing of tundish refractory linings (after sixteen or more hours of casting) can cause short interruption of casting, about fifteen minutes;

needs for a mold size change, replacing tundishes for refurbishing tundish refractory lining, and routine equipment maintenance procedures are coordinated during scheduling of operations to minimize likelihood of interruption of continued sequential heat casting for any such individual cause;

tundish shrouds are replaceable, when needed, by momentary suspension of tundish metal delivery while mold action continues, and ladle shrouds are replaced with each ladle changeover, so that neither causes an interruption in continued sequential heat casting.

Continued sequential heat continuous casting is not otherwise interrupted; and, transition casts (slabs or other shapes) of previous practice which had nonmetal solid inclusions due to the ladle changeover are eliminated.

While specific values, capacities, materials, times, and the like, have been set forth in describing a specific embodiment, it should be recognized that in the light of such teachings, other values and embodiments can be devised by those skilled in the art; therefore, for purposes of determining the scope of the invention, reference shall also be had to the scope of the appended claims.

We claim:

1. Method for decreasing entrapment of nonmetal solids in molten metal during handling for continuous casting, comprising:

A. providing a source of molten metal with flow control means for controlling delivery of molten metal, free of contact with ambient atmosphere, from such source;

B. providing a non-pressurized tundish for receiving molten metal from such source and accumulating molten metal;

C. providing continuous-casting mold means for receiving molten metal from such tundish and initiating solidification of such metal;

D. providing flow control means for gravity flow of molten metal, free of exposure to ambient atmosphere, from such non-pressurized tundish into molten metal of such continuous-casting mold means, E. establishing a nonmetal slag cover for surface protection of such tundish molten metal;

F. providing an elongated shroud in communication with such molten metal source for passage of molten metal, free of contact with ambient atmosphere, from such molten metal source toward such non-pressurized tundish, such shroud having a discharge distal end for disposition in molten metal of such non-pressurized tundish;

G. providing a source of nonreactive gas under pressure;

H. selecting a surface area of such tundish molten metal for removal of nonmetal slag cover;

I. establishing means for controlling discharge of such nonreactive gas so as to contact such nonmetal slag cover;

J. exposing such selected surface area of tundish molten metal so as to be free of slag cover by discharging such pressurized gas so as to displace slag cover from such selected surface area;

K. positioning such discharge distal end of such elongated shroud in tundish molten metal at such selected exposed surface so as to enable addition of molten metal from such source subsurface of such tundish molten metal;

L. discontinuing such discharge of nonreactive gas for displacement of slag cover so as to enable tundish slag to re-cover any remaining portion of such exposed molten metal surface area surrounding such elongated shroud, and M. delivering molten metal, by gravity flow, from such source subsurface of such exposed surface area into such tundish molten metal.

2. The method of claim 1, further including locating such selected surface area of tundish molten metal so as to be substantially vertically below such shroud discharge distal end, and moving such shroud vertically downwardly so as to submerge its discharge distal end into such tundish molten metal through such selected surface area, which is free of slag cover, so as to avoid entrapment of nonmetal slag cover as molten metal is being delivered from such source into such tundish for purposes of continuous casting.

3. Method for decreasing nonmetal slag entrapment in molten metal during its movement toward continuous casting, comprising:

A. providing ladle means for carrying molten metal, equipped with flow control means for controlling delivery of molten metal free of contact with ambient atmosphere, from such ladle;

B. providing casting mold means capable of receiving and accumulating molten metal during initiation of metal solidification for continuous casting;

C. positioning non-pressurized tundish means for receiving molten metal moving under gravity from such ladle means for transfer, free of contact with ambient atmosphere, to such casting means, such non-pressurized tundish means providing chamber means defining an open upper access for receiving molten metal delivered from such ladle means and accumulating molten metal with an accessible upper surface;

D. establishing a nonmetal slag cover for protection of such accessible upper surface of tundish molten metal, E. positioning the non-pressurized ladle means to be capable of delivering molten metal moving under gravity from such ladle into such tundish;

F. providing an elongated ladle shroud in communication with the ladle means for passage of molten metal, free of contact with ambient atmosphere, from such ladle into such tundish, such shroud having a discharge distal end;

G. providing means, free of contact with ambient atmosphere, for controlling gravity-flow delivery of tundish molten metal at a controlled rate into such casting mold means;

H. providing a source of nonreactive gas under pressure capable of displacing slag cover at such accessible upper surface of tundish molten metal;

I. selecting a designated surface area of such upper surface of tundish molten metal for displacement of slag cover, with size and location of such designated surface area being selected to enable receiving molten metal moving under gravity from such ladle means through such ladle shroud;

J. exposing such selected surface area so as to be free of such slag cover by discharging such nonreactive gas under pressure so as to displace nonmetal slag cover from such selected surface area;

K. moving such shroud discharge distal end through such selected surface area from which nonmetal slag cover has been removed so as to enable gravity-flow delivery of molten metal while submerged in tundish molten metal, then L. discontinuing discharge of such nonreactive gas so as to enable nonmetal slag to re-cover any remaining portion of such designated surface area surrounding such elongated shroud as submerged in tundish molten metal, and M. delivering molten metal by gravity-flow from such ladle means through such shroud discharge distal end into such tundish molten metal so as to avoid entrapment of nonmetal slag in such molten metal being delivered by gravity-flow for casting.

4. The process of claim 1 or 3, including selecting such molten metal from the group consisting of steel, stainless steel, aluminum, magnesium, copper, and alloys of each such metal.

5. The process of claim 3, in which such molten metal comprises low-carbon steel, with provision of ladle means having a capacity which exceeds molten steel capacity of such tundish means, and selecting molten steel capacity of such tundish means to be sufficient to enable continuous casting of molten steel at a selected casting rate so as to provide for uninterrupted continuous casting of molten steel at such casting mold means.

6. The process of claim 5, including positioning such ladle means and tundish means to enable vertically-oriented movement of molten steel, under gravity, from each such ladle means into molten metal of such tundish means, positioning such non-pressurized tundish means and such casting mold means to enable vertically-oriented movement of molten steel, by solely gravity flow, from such tundish means, such casting mold means receiving and accumulating such molten steel during initiation of solidification, and providing surface protection of molten metal as accumulating in such casting mold means for such solidification and continuous casting.

7. The process of claim 6, in which such mold means for continuous casting is provided by:

selecting casting mold means of predetermined cross-section in a plane transverse to a casting direction for movement of solidifying cast steel from such mold means, providing a mold lubricant for establishing upper surface cover for molten steel as accumulating in such mold means so as to prevent exposure of such molten steel to ambient atmosphere, and providing support means for solidifying cast steel as it is moving from such casting mold means, with such casting mold means being selected for cooling molten steel sufficiently to form a solidified peripheral shell, corresponding to such transverse cross-section of such casting mold means, so as to enable cast steel to move along a predetermined travel path from such solidifying cast steel, with such support means extending along such travel path to provide support during continued solidification of molten steel within such solidified peripheral shell.

8. The process of claim 3, including selecting molten low carbon steel having a carbon content of up to 0.30% by weight for continuous casting;

selecting molten steel capacity for such ladle means to accommodate replenishment of molten steel from sequential steelmaking heats selected from the group consisting of basic oxygen furnace heats and electric furnace heats;

providing for selecting control of such molten steel delivery rate from such tundish means and for selecting control of molten steel casting rate by such casting mold means, and selecting molten steel capacity for such tundish means to enable continued casting of molten steel at a selected casting rate during replenishment of ladle means molten steel so as to provide for uninterrupted continuous casting of steel from a plurality of sequential steelmaking heats.

9. The process of claim 6, including selecting relative capacities of ladle means, tundish means and casting mold means;

providing for selection of molten steel casting rates to enable interruption-free continuous casting of steel obtained from a plurality of sequential steelmaking heats;

continuously casting molten steel from such sequential steelmaking heats by coordinating selection of casting rate to delivery of molten steel from such sequential steelmaking heats, and providing for delivery of molten steel into such tundish means by submerging the discharge distal end of each such elongated ladle shroud, used for delivery of molten steel from such plurality of sequential steelmaking heats, into a selected surface area of tundish molten metal from which slag cover has been removed so as to avoid entrapment of nonmetal slag cover throughout casting of such plurality of sequential steelmaking heats.

10. The process of claim 1 or 3, including selecting such pressurized nonreactive gas for moving such slag cover from such selected surface area of the tundish molten metal from the group consisting of:

A. argon,

B. nitrogen, and

C. combinations thereof; and discharging such selected gas subsurface of tundish molten metal so as to move upwardly through such tundish molten metal and emerge from such molten metal contiguous to such selected surface area so as to receive such shroud discharge distal end within such tundish molten metal free of nonmetal slag entrapment.

* * * * *